US007641323B2

(12) United States Patent
Nagashima

(10) Patent No.: US 7,641,323 B2
(45) Date of Patent: Jan. 5, 2010

(54) LIQUID EJECTION HEAD

(75) Inventor: Kanji Nagashima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 462 days.

(21) Appl. No.: 11/239,301

(22) Filed: Sep. 30, 2005

(65) Prior Publication Data

US 2006/0071966 A1 Apr. 6, 2006

(30) Foreign Application Priority Data

Sep. 30, 2004 (JP) ..... 2004-289161

(51) Int. Cl.
*B41J 2/045* (2006.01)
*B41J 29/393* (2006.01)

(52) U.S. Cl. ..... 347/70; 347/19

(58) Field of Classification Search ..... 347/14, 347/68–72, 19, 20; 310/366
See application file for complete search history.

(56) References Cited

U.S. PATENT DOCUMENTS 4,469,978 A * 9/1984 Hamada et al. ..... 310/366
4,695,852 A * 9/1987 Scardovi ..... 347/14
4,894,698 A * 1/1990 Hijikigawa et al. ..... 257/254
5,757,392 A 5/1998 Zhang
5,929,875 A * 7/1999 Su et al. ..... 347/19
6,276,774 B1 * 8/2001 Moghadam et al. ..... 347/11

FOREIGN PATENT DOCUMENTS

JP 6-155733 A 6/1994
JP 7-132592 A 5/1995
JP 11291496 A * 10/1999
JP 2000-301714 A 10/2000
WO WO 2004/070335 A1 * 9/2004

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The liquid ejection head includes an ejection port which ejects liquid onto an ejection receiving medium; a pressure chamber which applies pressure for ejection to the liquid to be ejected from the ejection port; and a plurality of pressure determination elements which are provided on at least one of wall faces constituting the pressure chamber and have characteristic different from each other.

21 Claims, 13 Drawing Sheets

LIQUID EJECTION HEAD

BACKGROUND OF THE INVENTION

1. Field of the Invention

The present invention relates to a liquid ejection head, and more particularly, to pressure determination technology for a liquid ejection head which ejects liquid onto an ejection receiving medium.

2. Description of the Related Art

An inkjet recording apparatus having an inkjet type of print head forms a desired image on a medium by ejecting ink from a plurality of nozzles provided in the print head. In an inkjet recording apparatus of this kind, it is possible to judge the state of the pressure chambers and nozzles on the basis of a determination signal obtained by determining the pressure in the pressure chambers which accommodate the ink that is ejected from the respective nozzles. For example, if the frequency of the determined pressure (pressure wave) is lower than the resonance frequency of the pressure chamber, then it can be judged that an air bubble has occurred inside the pressure chamber, and that an ejection abnormality has arisen in the nozzle which ejects the ink accommodated in that pressure chamber.

In the ink spraying apparatus described in Japanese Patent Application Publication No. 6-155733, a drive pulse is applied to a piezo element by a drive device, thereby causing the piezo element to deform a plurality of times, and hence the ink inside an ink chamber is gradually sprayed and forms into one ink droplet. A determination device determines the variation in the ink inside the ink chamber after each prescribed number of pulses of the drive pulse, and a subsequent pulse is generated on the basis of the determination result, in such a manner that the pulse interval between a plurality of pulse driving actions is adjusted to achieve an optimal driving state.

Furthermore, in the piezoelectric liquid droplet spraying apparatus described in Japanese Patent Application Publication No. 7-132592, a drive pulse for measurement is applied to a piezo element prior to a printing operation, the pressure variation in the pressure chamber is determined by means of the piezo element and a determination circuit, and the drive waveform is calculated on the basis of the characteristics of the pressure variation.

In the inkjet recording head and inkjet recording apparatus described in Japanese Patent Application Publication No. 2000-301714, a flexible film is provided on at least one surface of an ink reservoir, and the flexible film contains drive elements comprising a piezoelectric material layer and a pair of electrodes. Therefore, pressure changes in the reservoir can be absorbed effectively.

However, since the signals obtained from pressure sensors often have a very weak current or a very weak voltage and pulse noise is often superimposed on the determination signals, then it may be impossible to determine the pressure accurately due to the effects of the noise on the determination signal. In particular, if the pressure sensor does not have suitable characteristics (frequency characteristics), then the S/N ratio will be high and will have a great affect on the determination signal.

In the ink spraying apparatus defined in Japanese Patent Application Publication No. 6-155733, the piezoelectric liquid droplet spraying apparatus described in Japanese Patent Application Publication No. 7-132592 and the inkjet recording head and inkjet recording apparatus described in Japanese Patent Application Publication No. 2000-301714, there is no disclosure regarding specific solutions for improving determination accuracy.

SUMMARY OF THE INVENTION

The present invention has been contrived in view of the foregoing, an object thereof being to provide a liquid ejection head which achieves highly accurate determination of the pressure in the pressure chambers provided in the liquid ejection head, by improving the sensitivity of pressure determination in the pressure chambers.

In order to attain the aforementioned object, the present invention is directed to a liquid ejection head, comprising: an ejection port which ejects liquid onto an ejection receiving medium; a pressure chamber which applies pressure for ejection to the liquid to be ejected from the ejection port; and a plurality of pressure determination elements which are provided on at least one of wall faces constituting the pressure chamber and have characteristic different from each other.

According to the present invention, since a plurality of determination pressure elements having different characteristics are provided on at least one of the wall faces which constitute the pressure chamber, then it is possible to determine pressure with a high degree of sensitivity, in cases where the drive conditions vary, or the liquid properties vary. Furthermore, by performing highly sensitive pressure determination, the S/N ratio is raised and improved determination accuracy can be expected.

Two or more pressure determination elements having different characteristics may be provided on one face, or pressure determination elements having different characteristics may be provided respectively on a plurality of faces. Furthermore, it is also possible to provide pressure determination elements on all of the faces which constitute the pressure chamber. A mode may also be adopted in which regions obtained by dividing up an integrally formed element are used as the plurality of pressure determination elements.

Furthermore, it is possible to judge the state of the pressure chamber or the state of the ejection port corresponding to the pressure chamber, on the basis of pressure information obtained from the pressure determination element.

The differing characteristics of the pressure determination elements may include the resonance frequency (frequency characteristics) and the dynamic range. "Ejection receiving medium" indicates a medium on which an image is recorded by means of the action of the ejection head (this medium may also be called a print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an inkjet head, and the like.

The ejection head may be a full line type head in which ejection ports are arranged through a length corresponding to the entire width of the ejection receiving medium, or a serial type head (shuttle scanning type head) in which a short head having ejection ports arranged through a length that is shorter than the entire width of the ejection receiving medium ejects recording liquid onto the ejection receiving medium while scanning in the breadthways direction of the ejection receiving medium.

A full line ejection head may be formed to a length corresponding to the full width of the recording medium by combining short head having rows of ejection ports which do not reach a length corresponding to the full width of the ejection receiving medium, these short heads being joined together in a staggered matrix fashion.

In order to attain the aforementioned object, the present invention is also directed to a liquid ejection head, comprising: an ejection port which ejects liquid onto an ejection receiving medium; a pressure chamber which applies pressure for ejection to the liquid to be ejected from the ejection port; and a pressure determination element which is provided on at least one of wall faces constituting the pressure chamber and has different characteristics in different parts thereof.

As a mode for providing a pressure determination element having different characteristics on a plurality of the wall faces which constitute the pressure chamber, it is possible to adopt a mode in which the respective regions of an integrally formed pressure determination element having a plurality of regions of different characteristics are disposed on respective wall faces of the pressure chamber.

Preferably, the pressure determination element is disposed so as to cover at least two of the wall faces constituting the pressure chamber and has the different characteristics respectively on the at least two of the wall faces.

By providing the pressure determination element so as to cover a plurality of the faces which constitute the pressure chamber, it is possible to increase the size of the pressure determination element, and hence determination sensitivity can be improved.

In order to attain the aforementioned object, the present invention is also directed to a liquid ejection head, comprising: an ejection port which ejects liquid onto an ejection receiving medium; a pressure chamber which applies pressure for ejection to the liquid to be ejected from the ejection port; and a plurality of pressure determination elements which are provided on a plurality of wall faces constituting the pressure chamber and have characteristics different from each other.

By providing a plurality of pressure determination elements having different characteristics on the wall faces which constitute the pressure chamber, it is possible to set the determinable pressure range (dynamic range) to a broad range.

Preferably, the plurality of pressure determination elements are disposed in such a manner that one pressure determination element is provided on one wall face.

If each pressure determination element is provided on each wall face of the pressure chamber, then it is possible to increase the size of the respective pressure determination elements, and hence determination sensitivity can be improved.

Preferably, the different characteristics include resonance frequencies.

Since the plurality of piezoelectric elements, or the plurality of regions of different characteristics in one piezoelectric element, are composed in such a manner that they have different resonance frequencies, then it is possible to determine the pressure wave generated in the pressure chamber, with a high degree of sensitivity, over a broad range of frequencies.

If an air bubble occurs in the pressure chamber, then the frequency of the pressure chamber generated in the pressure chamber is dependent on the size of the air bubble. It is possible to specify the resonance frequencies of the pressure determination elements on the basis of the estimated range of sizes of an air bubble which may occur inside the pressure chamber.

Preferably, the liquid ejection head further comprises: an actuator which deforms the pressure chamber and is provided on at least one of the wall faces constituting the pressure chamber, wherein the pressure determination element or the part of the pressure determination element having the resonance frequency corresponding to a most commonly used drive frequency of the actuator is provided on the wall face having a greatest surface area for disposing the pressure determination element.

By achieving a large surface area for the pressure determination element having a resonance frequency that corresponds to the most commonly used drive frequency of the ejection drive actuator, it is possible to improve the determination sensitivity of the pressure determination element which has a high determination rate.

The resonance frequency corresponding to the most commonly used drive frequency may be substantially equal to the drive frequency, or it may be a multiple of n times or 1/n times the drive frequency (where n is a natural number).

The face on which a pressure determination element can be disposed may be a planar surface, or it may be a non-planar surface, such as a spherical surface.

A diaphragm (pressure plate) which also serves as a wall face of the pressure chamber is provided, and the actuator may be disposed on the surface of the diaphragm opposite to the pressure chamber (or on the same side as the pressure chamber), or alternatively, a wall face of the pressure chamber may be formed to serve as an actuator.

Alternatively, it is also preferable that the liquid ejection head further comprises: an actuator which deforms the pressure chamber and is provided on at least one of the wall faces constituting the pressure chamber, wherein the pressure determination element or the part of the pressure determination element having the resonance frequency corresponding to a most commonly used drive frequency of the actuator is provided on the wall face opposing the wall face on which the actuator is provided.

Taking account of the linearity of the pressure wave in the pressure chamber, if a pressure determination element having a resonance frequency corresponding to the most commonly used drive frequency is provided on the surface which opposes the actuator installation surface, then highly sensitive pressure determination can be achieved in respect of the most commonly used drive frequency.

It is also possible to form the surface opposing the actuator installation surface, by means of a plurality of surfaces.

Alternatively, it is also preferable that the liquid ejection head further comprises: an actuator which deforms the pressure chamber and is provided on at least one of the wall faces constituting the pressure chamber, wherein the pressure determination element or the part of the pressure determination element having the highest resonance frequency is provided on the wall face opposing the wall face on which the actuator is provided.

A pressure determination element having the lowest resonance frequency should be provided on a surface that is substantially perpendicular to the actuator installation surface.

Preferably, the pressure determination elements include piezoelectric elements; and the resonance frequencies of the piezoelectric elements or the parts of one piezoelectric element are differentiated by differentiating at least one of thickness and rigidity of the piezoelectric elements or the parts of one piezoelectric element.

If piezoelectric elements are used as the pressure determination elements having different characteristics, then these elements having different characteristics can be manufactured readily.

The mode of providing a plurality of piezoelectric elements having different characteristics may include providing individual elements for each region of an integrally formed piezoelectric element, in which the respective regions have different characteristics.

The rigidity of the piezoelectric element may be altered by changing the compositional ratio of the piezoelectric element.

A pair of extracting electrodes (determination signal extracting sections) for extracting a determination signal are provided at the piezoelectric elements which function as pressure determination elements, and these determination signal extracting sections may be used commonly between a plurality of piezoelectric elements. Furthermore, if the determination signal extracting electrodes are used commonly between a plurality of piezoelectric elements, then it is possible to transmit a determination signal comprising synthesized (mutually superimposed) determination signals obtained from the respective piezoelectric elements, by means of a common wire.

According to the present invention, since a plurality of pressure determination elements having different characteristics are provided on the wall faces which constitute each pressure chamber, it is possible to achieve highly sensitive pressure determination, even in cases where the determination conditions vary in terms of the frequency characteristics and/or the dynamic range of the pressure wave to be determined, and the like. Therefore, the S/N ratio can be raised and determination accuracy can be improved.

Furthermore, the plurality of pressure determination elements having different characteristics may be provided on one surface, or they may be provided, one by one, on a plurality of faces. Furthermore, a pressure determination element having a plurality of characteristics may be formed integrally over a plurality of faces.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
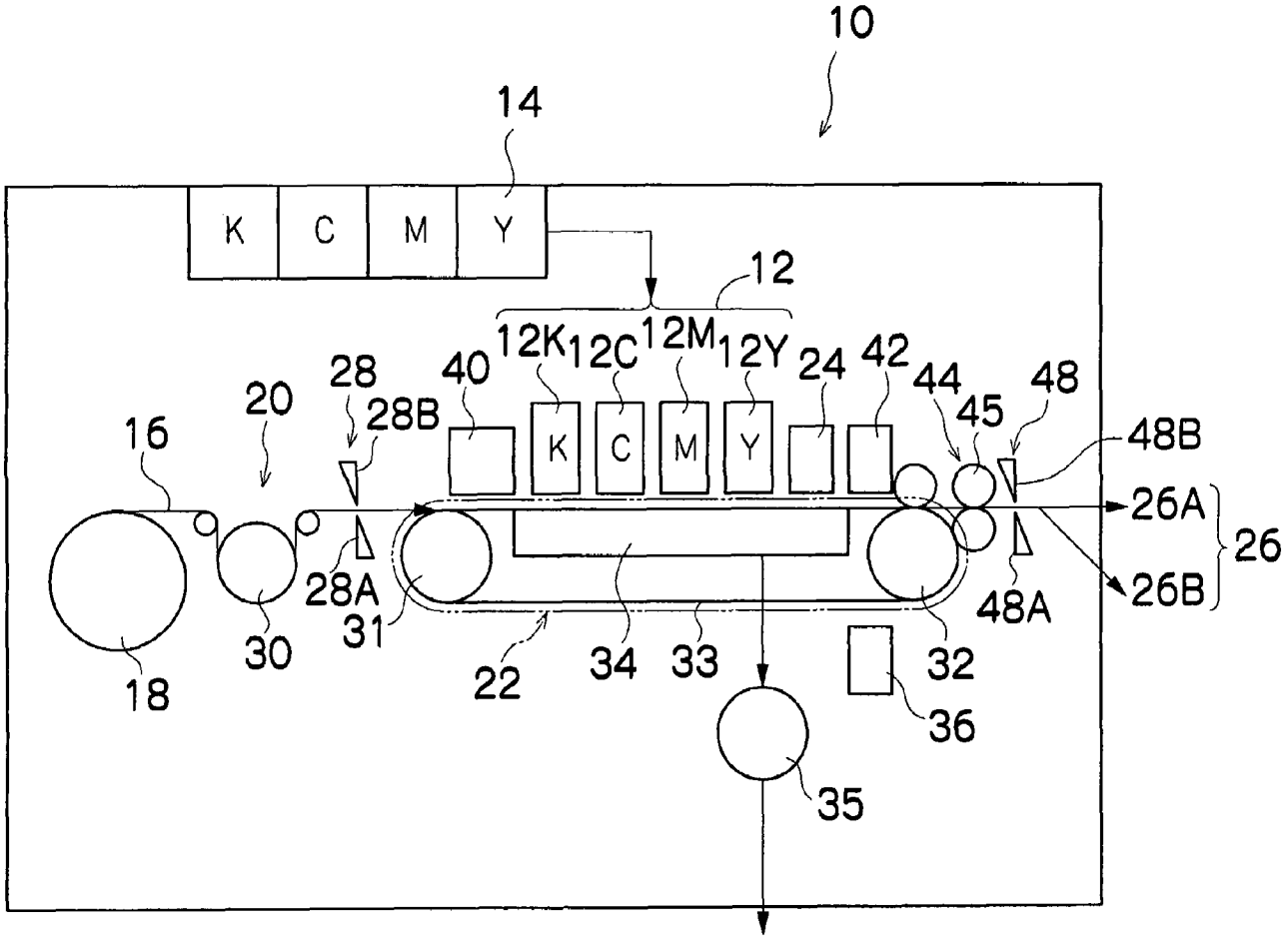
FIG. 1 is a general schematic drawing of an inkjet recording apparatus using with a print head according to an embodiment of the present invention.

FIG. 1 is a general schematic drawing of an inkjet recording apparatus using an image processing apparatus according to an embodiment of the present invention. As shown in FIG. 1, the inkjet recording apparatus 10 comprises: a print unit 12 having a plurality of ejection heads 12K, 12C, 12M, and 12Y provided for ink colors of black (K), cyan (C), magenta (M), and yellow (Y), respectively; an ink storing and loading unit 14 for storing inks of K, C, M and Y to be supplied to the heads 12K, 12C, 12M, and 12Y; a paper supply unit 18 for supplying recording paper 16, which forms a recording medium (ejection receiving medium); a decurling unit 20 removing curl in the recording paper 16; a suction belt conveyance unit 22 disposed facing the nozzle face (ink-droplet ejection face) of the print unit 12, for conveying the recording paper 16 while keeping the recording paper 16 flat; and a paper output unit 26 for outputting printed recording paper (printed matter) to the exterior.

The ink storing and loading unit 14 has ink tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
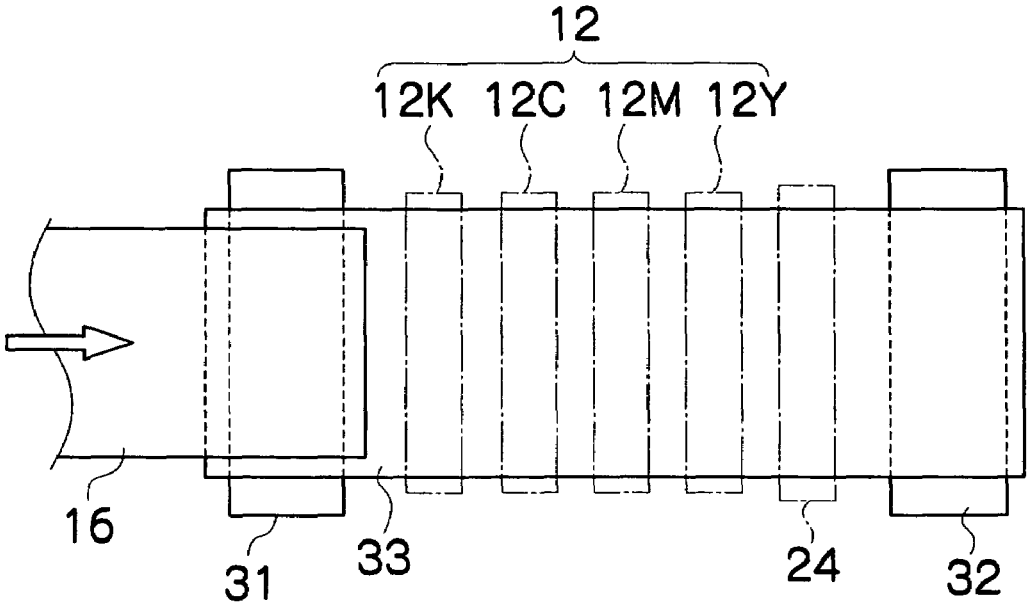
FIG. 2 is a plan view of the principal part of the peripheral area of a print unit in the inkjet recording apparatus shown in FIG. 1.

The heads 12K, 12C, 12M and 12Y of the print unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the print unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks or dark inks can be added as required. For example, a configuration is possible in which inkjet heads for ejecting light-colored inks such as light cyan and light magenta are added. Furthermore, there are no particular restrictions of the sequence in which the heads of respective colors are arranged.

A post-drying unit 42 is disposed following the print unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a head will be described. The heads 12K, 12C, 12M and 12Y of the respective ink colors have the same structure, and a reference numeral 50 is hereinafter designated to any of the heads.

Figure 3A:
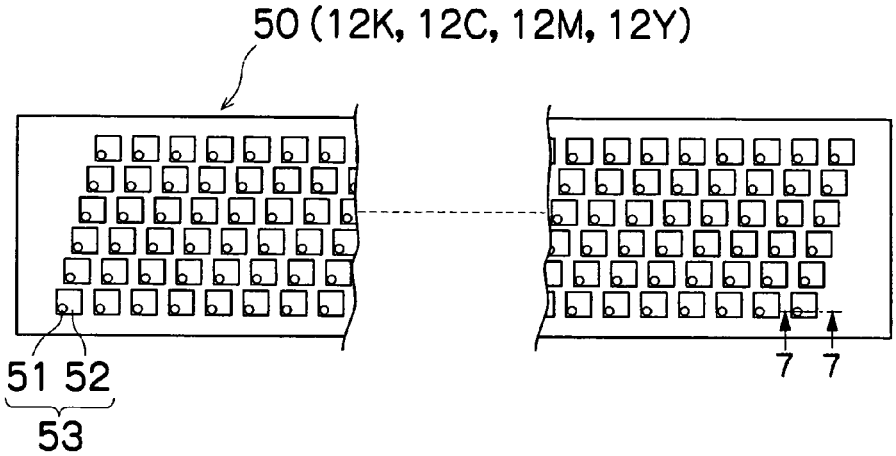
FIGS. 3A to 3C are plan perspective views showing a structural example of a print head according to the present embodiment.
Figure 3B:
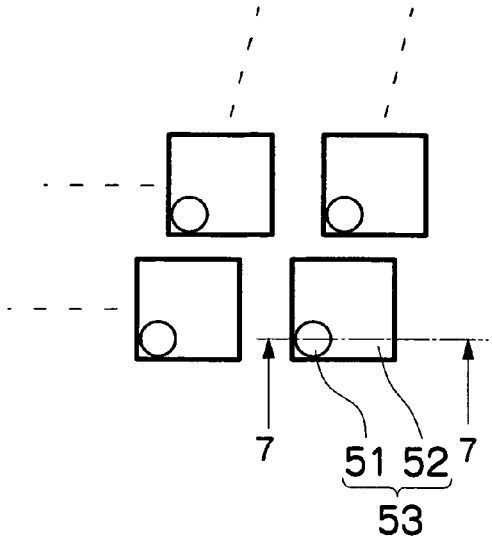
Figure 3C:
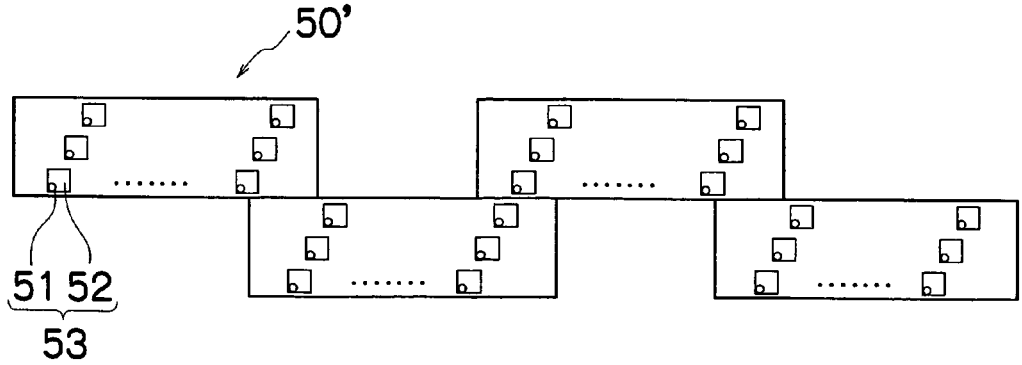
Figure 4:
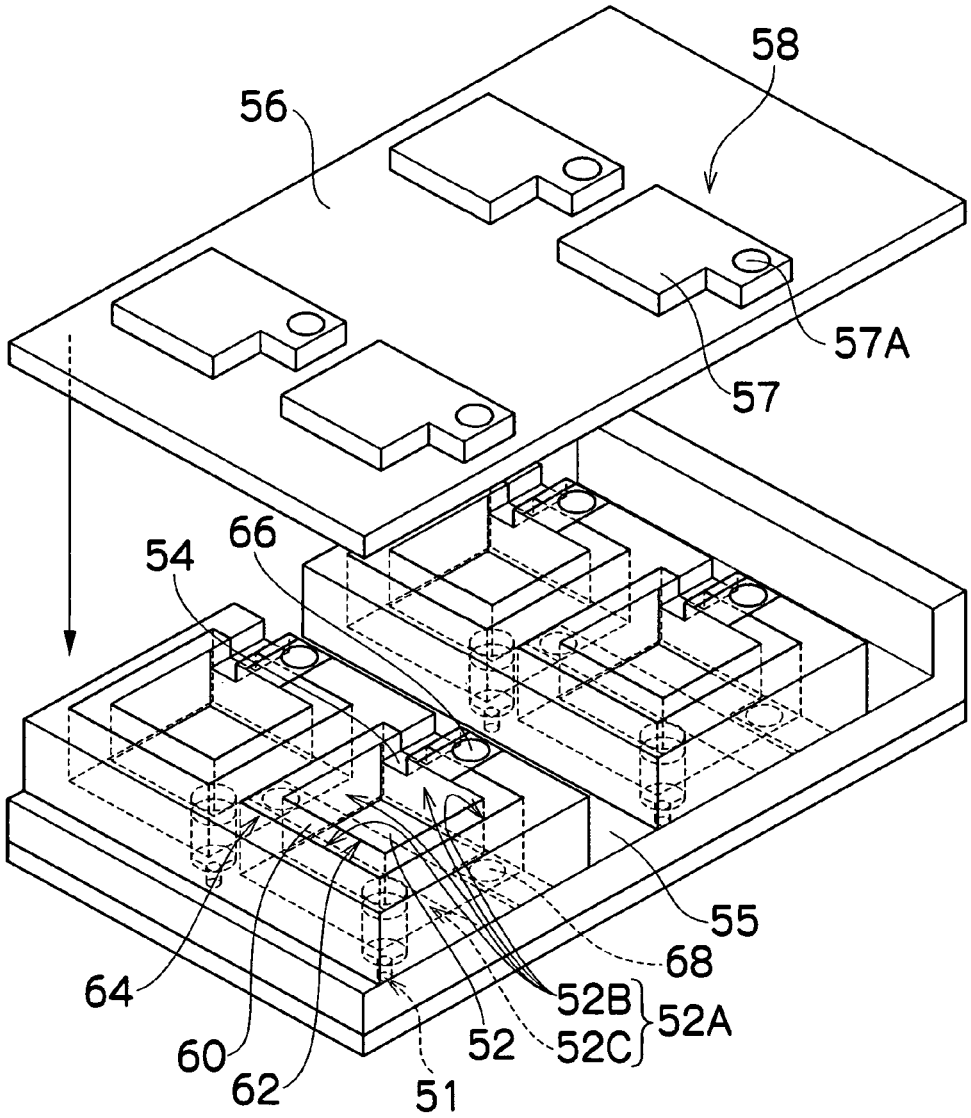
FIG. 4 is an oblique diagram showing a three-dimensional structure of a print head according to the present embodiment.

FIG. 3A is a plan perspective view showing an example of the composition of a print head 50, and FIG. 3B is an enlarged diagram of a portion of same. Furthermore, FIG. 3C is a plan perspective view showing a further example of the structure of a print head 50; and FIG. 4 is an oblique perspective diagram showing the three-dimensional composition of an ink chamber unit. In order to achieve a high density of the dot pitch printed onto the surface of the recording paper 16, it is necessary to achieve a high density of the nozzle pitch in the print head 50. As shown in FIGS. 3A and 3B, the print head 50 according to the present embodiment has a structure in which a plurality of ink chamber units 53, each comprising a nozzle (ejection port) 51 forming an ink droplet ejection port, a pressure chamber 52 corresponding to the nozzle 51, and the like, are disposed two-dimensionally in the form of a staggered matrix, and hence the effective nozzle interval as projected in the lengthwise direction of the head (the direction perpendicular to the paper conveyance direction) is reduced (high nozzle density is achieved).

The mode of forming one or more nozzle rows through a length corresponding to the entire width of the recording paper 16 in a direction substantially perpendicular to the conveyance direction of the recording paper 16 is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

The pressure chambers 52 provided corresponding to the nozzles 51 have a substantially square planar shape, and each nozzle 51 is provided in one of the four corers thereof.

FIG. 4 is an oblique diagram showing the three-dimensional structure of the ink chamber units 53 shown in FIG. 3B.

An ejection piezoelectric element 58 provided with an individual electrode (ejection individual electrode) 57 is bonded to a diaphragm 56 which forms the upper face of the pressure chamber 52 and also serves as a common electrode, and the ejection piezoelectric element 58 is deformed when a drive voltage is supplied to the ejection individual electrode 57, thereby causing ink to be ejected from the nozzle 51. When ink is ejected, new ink is supplied to the pressure chamber 52 from the common flow passage 55, via the supply port 54.

An ejection drive individual electrode lead 57A which is bonded to a wire (not shown) transmitting a drive signal to be supplied to the ejection piezoelectric element 58, is provided onto the ejection individual electrode 57 disposed on the upper surface of the ejection piezoelectric element 58 (namely, the side opposite to the diaphragm 56).

The ejection drive individual electrode lead 57A is bonded to the wire (or a pad provided on the wire), by means of a conductive adhesive, solder, or the like. Desirably, a flexible substrate is used for the member that forms the wires for transmitting the drive signals.

Here, the flexible substrate is shown as being made of copper wiring, or the like, formed on a resin sheet of polyimide, or the like. The wiring may be formed on either the front surface or the rear surface of the resin sheet, or it may be formed on both the front and rear surfaces thereof. As shown in FIG. 4, on the inner surfaces 52A of the walls forming the pressure chamber 52, determination piezoelectric elements 60 for determining the pressure generated in the pressure chamber 52 are provided respectively on the side faces 52B and the bottom face 52C apart from the ceiling.

The determination piezoelectric elements 60 provided on the respective faces in the present embodiment have respectively different resonance frequencies (frequency characteristics), and therefore, the pressure can be determined with good sensitivity, even if the frequency of the pressure wave generated in the pressure chamber 52 changes. The details of pressure determination are described hereinafter.

In FIG. 4, determination common electrodes 62 are provided respectively on the determination piezoelectric elements 60 on the faces of the pressure chamber 52, on the surface of the determination piezoelectric element 60 which makes contact with the ink accommodated inside the pressure chamber 52, and determination individual electrodes 64 are provided on the side faces of the pressure chamber 52. A protective film (protective layer) having an ink resistance treatment is formed on the portions of the determination common electrodes 62 which make contact with the ink.

Desirably, ink-attracting properties are imparted to the liquid-contacting sections where the determination common electrodes 62 are provided, in such a manner that a structure which improves the expulsion of air bubbles is achieved.

Figure 5A:
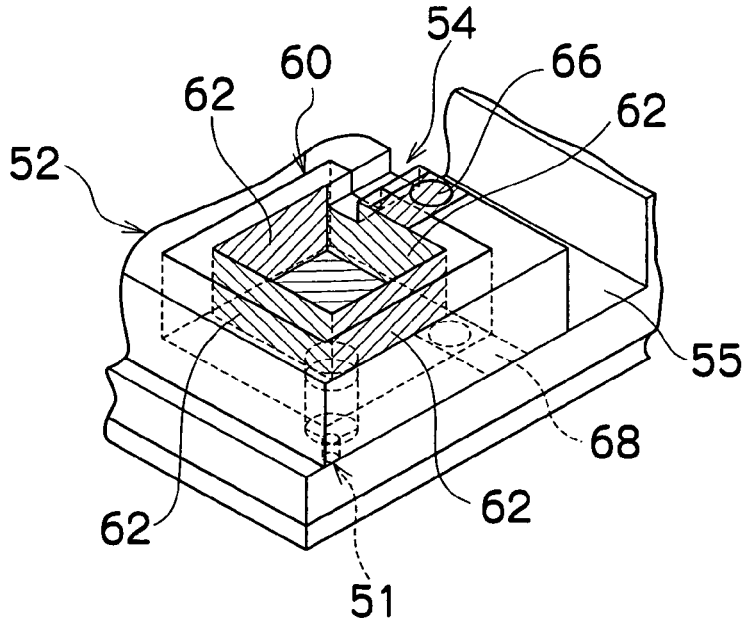
FIGS. 5A and 5B are enlarged views showing a pressure chamber provided in the print head shown in FIG. 4.
Figure 5B:
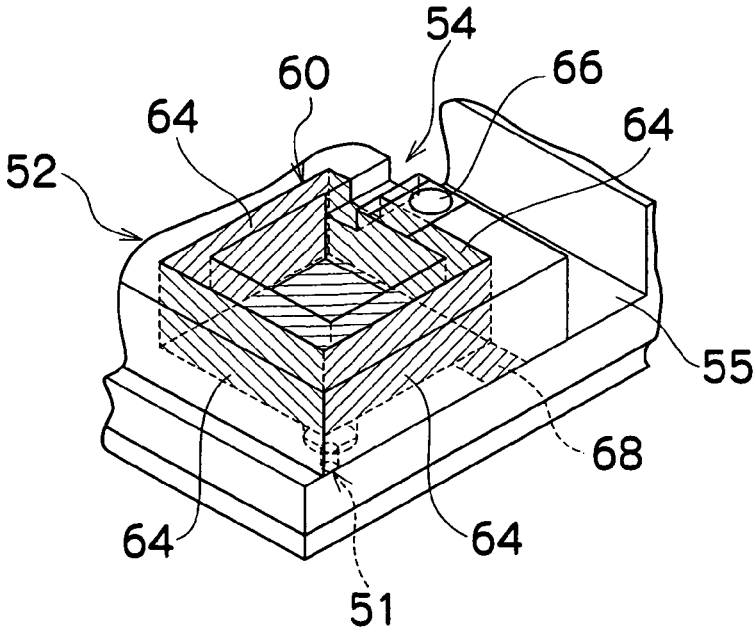

FIGS. 5A and 5B show the details of the arrangement of electrodes in the determination piezoelectric elements 60 described above, and the electrode wiring structure.

As shown in FIG. 5A, determination common electrodes 62 are provided on the surfaces forming the inner faces of the pressure chamber 52, and the determination common electrodes 62 of the determination piezoelectric elements 60 provided on the respective faces are all bonded together to form an electrical connection between each other, and are also bonded to form an electrical connection with a determination common electrode lead 66 provided on the upper surface of one of the four side walls which constitute the pressure chamber 52 (in other words, on the opposite side of the pressure chamber 52 from the nozzle 51).

Furthermore, as shown in FIG. 5B, the determination individual electrodes 64 are provided on the faces of the side walls which constitute the pressure chamber 52, and the determination individual electrodes 64 of the determination piezoelectric elements 60 provided on the faces of the pressure chamber are all bonded together to form an electrical connection between each other, and are also bonded to form an electrical connection with a determination individual electrode lead 68 provided on the lower surface of one of the four side walls which constitute the pressure chamber 52 (in other words, on the same side of the pressure chamber 52 as the nozzle 51).

More specifically, the determination piezoelectric elements 60 shown in FIG. 4 and FIGS. 5A and 5B have an electrode structure in which the determination common electrodes 62 and the determination individual electrodes 64 are respectively formed into common electrodes, and by adopting an electrode structure of this kind, it is possible to unify the wiring and to reduce the number of wires required.

The wire bonded to the determination individual electrode lead 68 transmits a signal in which a plurality of determination signals obtained from the respective determination piezoelectric elements 60 are superimposed on each other. Naturally, it is also possible to respectively provide independent wiring leads for the determination individual electrodes 64, and to send the signals obtained from the respective determination piezoelectric elements 60 in an independent fashion.

Composition of Ink Supply System and Maintenance System

Ink is supplied to the pressure chamber 52 shown in FIG. 4 from an ink tank (not shown) via a supply side flow channel, such as the common flow channel 55. This ink tank is the base tank for supplying ink, and is it disposed in the ink/storing and loading unit 14 shown in FIG. 1.

The ink tank may adopt a system for replenishing ink by means of a replenishing port (not shown), or a cartridge system in which a cartridge is exchanged independently for each tank, whenever the residual amount of ink has become low. If the type of ink is changed in accordance with the type of application, then a cartridge based system is suitable. In this case, desirably, type information relating to the ink is identified by means of a bar code, IC chip, or the like, and the ejection of the ink is controlled in accordance with the ink type.

Furthermore, a filter (not shown) is provided between the ink tank and the print head 50 in order to remove foreign matter and air bubbles. Desirably, the filter mesh size is the same as the nozzle diameter, or smaller than the nozzle diameter (generally, about 20 μm to 50 μm). Moreover, desirably, a composition is adopted in which a sub-tank is provided in the vicinity of the print head 50, or in an integrated fashion with the print head 50. The sub-tank has the function of improving damping effects and refilling, in order to prevent variations in the internal pressure inside the head.

The inkjet recording apparatus 10 is also provided with a maintenance unit (not shown) comprising a cap, being a device for preventing the nozzles 51 from drying out and preventing increase in the viscosity of the ink in the vicinity of the nozzles, and a cleaning blade forming a device for cleaning the surface of the nozzles. The maintenance unit can be moved in a relative fashion with respect to the print head 50 by a movement mechanism (not shown), and is moved from a predetermined holding position to a maintenance position below the print head 50 as required.

The aforementioned cap is displaced upwards and downwards in a relative fashion with respect to the print head 50 by an elevator mechanism (not shown). When the power supply is off, or when the apparatus is at standby, the cap is raised to a prescribed raised position and sealed tightly onto the print head 50, thereby covering the nozzle surface with the cap.

The cleaning blade is composed of rubber or another elastic member, and can slide on the ink ejection surface of the print head 50 by means of a blade movement mechanism (not shown). If there are ink droplets or foreign matter adhering to the nozzle plate, then the nozzle plate surface is wiped by causing the cleaning blade to slide over the nozzle plate, thereby cleaning the nozzle plate surface.

During printing or standby, when the frequency of use of specific nozzles is reduced and ink viscosity increases in the vicinity of the nozzles, a preliminary discharge is made to eject the degraded ink toward the cap.

Also, when air bubbles have become intermixed in the ink inside the print head 50 (inside the pressure chamber 52), the cap is placed on the print head 50, ink (ink in which bubbles have become intermixed) inside the pressure chamber 52 is removed by suction with a suction pump, and the ink removed by suction is sent to a recovery tank. This suction operation is also carried out in order to remove degraded ink having increased viscosity (hardened ink), when ink is loaded into the head for the first time, and when the print head 50 starts to be used after having been out of use for a long period of time.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the ejection piezoelectric element 58 is operated. Before reaching such a state (in a viscosity range that allows ejection by the operation of the ejection piezoelectric element 58) the ejection piezoelectric element 58 is operated to perform the preliminary discharge to eject the ink of which viscosity has increased in the vicinity of the nozzle toward the ink receptor. After the nozzle surface is cleaned by the cleaning blade provided as the cleaning device for the nozzle face, a preliminary discharge is also carried out in order to prevent the foreign matter from becoming mixed inside the nozzles 51 by the cleaning blade sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the ejection piezoelectric elements 58 is operated. Also, when the ink viscosity inside the nozzle 51 has increased over a certain level, ink can no longer be ejected from the nozzle 51 even if the ejection piezoelectric elements 58 is operated. In these cases, a suctioning device to remove the ink inside the pressure chamber 52 by suction with a suction pump, or the like, is placed on the nozzle face of the print head 50, and the ink in which bubbles have become intermixed or the ink of which viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

The inkjet recording apparatus 10 has a function for determining an ejection abnormality in the nozzle 51 due to change in the pressure (pressure wave) of the pressure chamber 52. A nozzle maintenance operation (nozzle restoration operation), such as preliminary ejection or suctioning as described above, is performed in respect of a nozzle 51 which is determined to have an ejection abnormality due to blocking of the nozzle 51 or intermixing of air bubbles into the pressure chamber 52.

Description of Control System

Figure 6:
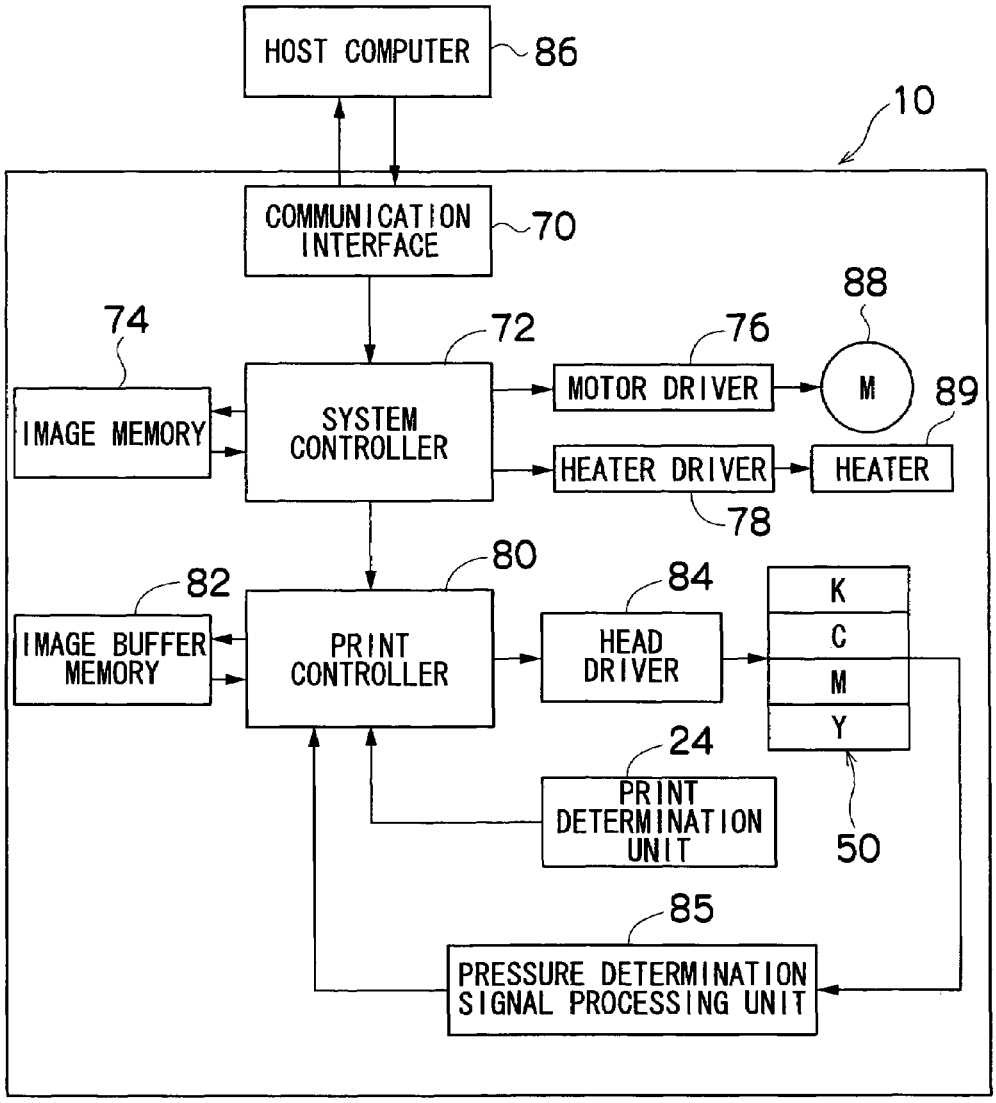
FIG. 6 is a principal block diagram showing the system configuration of the inkjet recording apparatus.

FIG. 6 is a principal block diagram showing the system composition of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, a pressure determination signal processing unit 85, and the like.

The communication interface 70 is an interface unit for receiving image data sent from a host computer 86. A serial interface such as USB, IEEE 1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74.

The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communication with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The image buffer memory 82 is provided in the print controller 80 and image data, parameters, and other data are temporarily stored in the image buffer memory 82 when image data is processed in the print controller 80. Also possible is a mode in which the print controller 80 and the system controller 72 are integrated to form a single processor.

The head driver 84 drives the ejection piezoelectric elements 58 of the heads of the respective colors 12K, 12C, 12M and 12Y on the basis of print data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

The head driver 84 generates drive control signals for the print head 50 on the basis of the dot data stored in the image buffer memory 82. By supplying the drive control signals generated by the head driver 84 to the print head 50, ink is ejected from the print head 50. By controlling ink ejection from the heads print 50 in synchronization with the conveyance velocity of the recording paper 16, an image is formed on the recording paper 16.

The pressure determination signal processing unit 85 is a signal processing unit which carries out prescribed signal processing, such as noise elimination and amplification, on the voltage (pressure determination signal) corresponding to the pressure variations in the pressure chamber 52 obtained from the determination piezoelectric elements 60 shown in FIG. 4. The determination signal processed by the pressure determination signal processing unit 85 is supplied to the print controller 80, and the presence or absence of a pressure abnormality in the pressure chamber 52 (an ejection abnormality at the nozzle 51) is judged.

In the present embodiment, a signal in which a plurality of pressure determination signals are superimposed on each other is transmitted using a common (a pair of) signal lines. In the pressure determination signal processing unit 85, the respective pressure determination signals are extracted from the signal comprising a plurality of superimposed pressure determination signals.

Various control programs are stored in a program storage section (not shown), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided.

The program storage section may also be combined with a storage device for storing operational parameters, and the like (not shown).

Description of Pressure Determination

Next, pressure determination in a pressure chamber 52 provided in the print head 50 will be described.

Determination piezoelectric elements 60 are provided as pressure sensors on all of the inner faces 52A of the pressure chambers 52 of the print head 50, or on a plurality of the inner faces 52A apart from the surface corresponding to the diaphragm 56, and determination common electrodes 62 and determination individual electrodes 64 are formed on the determination piezoelectric elements 60 in order to obtained determination signals.

Furthermore, the determination common electrodes 62 provided on the surfaces are bonded together to form an electrical connection between themselves, and these determination common electrodes 62 are also bonded so as to form an electrical connection with a common determination common electrode lead 66. Similarly, the determination individual electrodes 64 are bonded together to form an electrical connection between themselves, and these determination individual electrodes 64 are also bonded so as to form an electrical connection with a common determination individual electrode lead 68. The determination common electrode lead 66 and the determination individual electrode lead 68 are bonded to a wiring layer in which wires are formed, or to a flexible substrate.

In general, provided that piezoelectric elements (piezoelectric bodies) have the same thickness and material properties, then they generate a voltage that is directly proportional to the pressure applied to them. The voltage thus generated is not dependent on the surface area of the piezoelectric element and the individual electrode provided on the piezoelectric element.

On the other hand, the charge (current) generated by the piezoelectric element is directly proportional to the surface area of the piezoelectric element and the individual electrode, and therefore, if determination piezoelectric elements 60 are provided on the inner faces of the pressure chamber 52, then it is possible to increase the surface area of the determination piezoelectric elements 60 and the surface area of the determination individual electrodes 64, and hence a larger charge can be obtained. Consequently, the S/N ratio in the pressure determination signal is improved, the pressure in the pressure chamber 52 can be determined with greater sensitivity, and therefore the determination accuracy is improved.

Furthermore, a piezoelectric element having excellent determination characteristics and large values for the piezoelectric output coefficients (g constant, electrical-mechanical conversion constant, piezoelectric strain constant) is desirable for determining the pressure. A resin material (a fluoride resin type material), such as PVDF (polyvinylidene fluoride) or PVDF-TrFE (polyvinylidene fluoride—trifluoroethylene copolymer) is suitable for a piezoelectric element having excellent determination characteristics.

Furthermore, it is also possible to use a piezoelectric element obtained by altering the compositional ratio of a ceramic type piezoelectric element having excellent ejection characteristics, in such a manner that the determination characteristics thereof are improved. More specifically, one example of a ceramic material is lead zirconate titanate (PZT) ($Pb(Zr—Ti)O_3$), and taking lead titanate ($PbTiO_3$) which is a ferroelectric material, and lead zirconate ($PbZrO_3$) which is an antiferroelectric material to be the basic components, it is possible to control various properties of the ceramic material, such as the piezoelectric, dielectric and elastic characteristics, by changing the ratio in which these two components are combined. Consequently, a piezoelectric ceramic material can be obtained which has good pressure determination efficiency in addition to good ink ejection efficiency.

In other words, desirably, a resin type piezoelectric element made of PVDF, P(VDF-TrFE), or the like, is used for the determination piezoelectric element 60, but it is also possible to form a determination piezoelectric element 60 by altering the compositional ratio of a ceramic type piezoelectric element made of PZT, or the like.

First Embodiment

Figure 7:
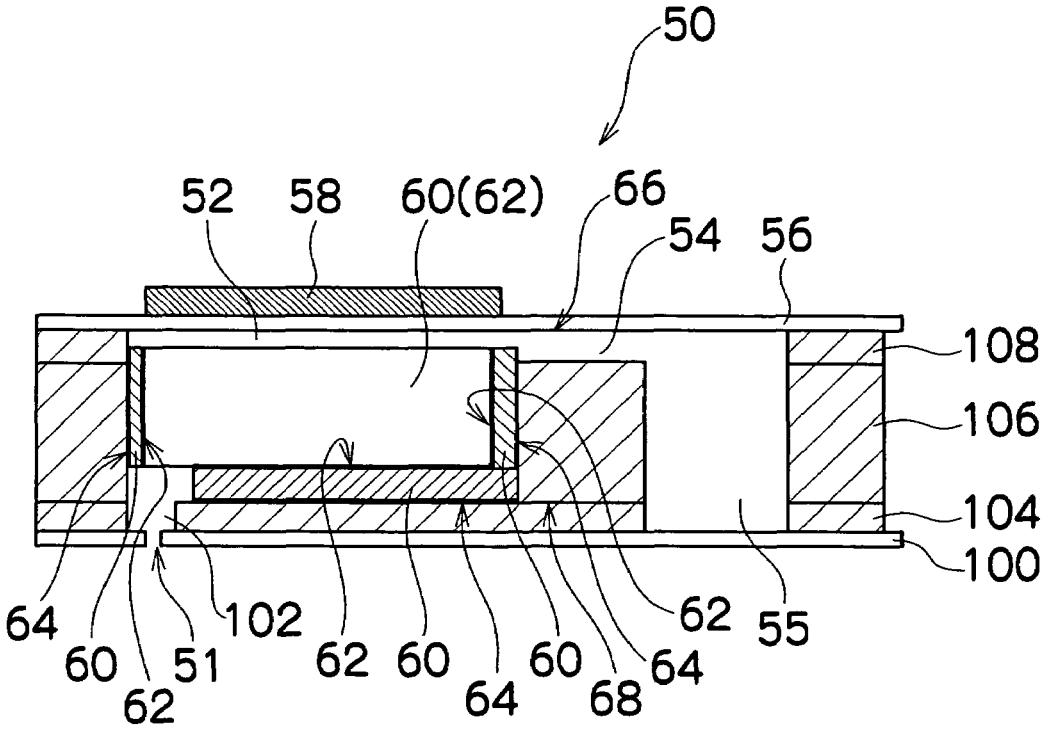
FIG. 7 is a cross-sectional view along line 7-7 of the print head in FIGS. 3A to 3C.

FIG. 7 shows a print head 50 according to a first embodiment of the present invention. FIG. 7 is a cross-sectional diagram along line 7-7 in FIG. 3A. In the first embodiment, piezoelectric elements made from a resin type material having excellent pressure determination characteristics are used for the determination piezoelectric elements 60, and previously formed piezoelectric elements made from a resin type material are bonded by means of adhesive, or the like, onto the surfaces where the determination piezoelectric elements 60 are to be provided.

The print head 50 shown in FIG. 7 has a laminated structure in which a plurality of cavity plates formed with liquid chambers such as nozzles 51, pressure chambers 52 and supply ports 54, and openings, holes and grooves forming flow channels, and the like, are layered together.

The print head 50 has a structure formed by sequentially layering, from the bottom upward: a nozzle plate 100 formed with holes which are to be nozzles 51; a flow channel plate 104 formed with holes which are to be ejection side flow channels 102 for connecting the nozzles 51 with the pressure chambers 52, and openings (holes) which are to form a portion of the common liquid chamber 55; a pressure chamber plate 106 formed with openings which are to form pressure chambers 52; a supply port plate 108 formed with openings (grooves) which are to form supply ports 54, the diaphragm 56; and ejection piezoelectric elements 58.

The laminated structure shown in FIG. 7 can be formed by adhesion of stainless steel thin plates, silicon etching (silicon processing), resin molding, or the like. In the print head 50 shown in the present embodiment, pressure chambers 52 having a "bathtub" shape (recess shape) are formed by forming (assembling) the faces other than the ceilings of the pressure chambers 52, which are constituted by a diaphragm 56.

Determination common electrodes 62, a protective film, and determination piezoelectric elements 60 formed with determination individual electrodes 64 are bonded by adhesion, or the like, to the surfaces of these pressure chambers 52 on which the determination piezoelectric elements are to be installed.

Thereupon, the determination common electrodes 62 of the determination piezoelectric elements 60 bonded to the respective determination piezoelectric element installation surfaces are all bonded together to form an electrical connection between each other, by means of a conductive adhesive, solder, or the like, and furthermore, they are bonded so as to form an electrical connection with the determination common electrode lead 66 shown in FIGS. 4, 5A, and 5B. A protective film having ink resistance properties and ink attracting properties is formed on the surfaces of the determination common electrodes 62.

Similarly, the determination individual electrodes 64 of the determination piezoelectric elements 60 are all bonded together to form an electrical connection between each other, and are also bonded so as to form an electrical connection with the determination individual electrode lead 68 shown in FIGS. 4, 5A, and 5B, by means of a conductive adhesive, solder, or the like.

Gold, silver, copper, aluminum or a compound containing these materials is used for the determination common electrodes 62 and the determination individual electrodes 64, and polyimide, or the like, is used for the protective film formed on the surface of the determination common electrodes 62. The thickness of the protective film is approximately 1 to 2 μm.

Furthermore, if the surfaces which make contact with the determination individual electrodes 64 (in other words, the inner faces of the pressure chamber 52) are made from a material containing metal, then an insulating member (insulating film) is formed between the determination individual electrodes 64 and the surfaces which make contact with the determination individual electrodes 64.

Thereupon, holes for forming nozzles 51 are formed in the nozzle plate 100, and a diaphragm 56 and ejection piezoelectric elements 58 are bonded by adhesion, or the like, to the opposite side of the pressure chambers 52 from the nozzles 51.

In the first mode shown in FIG. 7, piezoelectric elements made of a resin type material which are suitable for pressure determination are used for the determination piezoelectric elements 60, and therefore the pressure can be determined with good efficiency.

In the mode shown in FIG. 7, determination piezoelectric elements 60 of different thicknesses are provided on the respective walls of the pressure chamber 52. The relationship between the thickness of the determination piezoelectric element 60 and the pressure determination action is described in detail below, but by making the determination piezoelectric elements 60 provided on the walls of the pressure chamber have different thicknesses, it is possible to vary the frequency characteristics of the determination sensitivity. Of course, it is also possible to provide determination piezoelectric elements 60 of the same thickness on different walls.

Second Embodiment

Figure 8A:
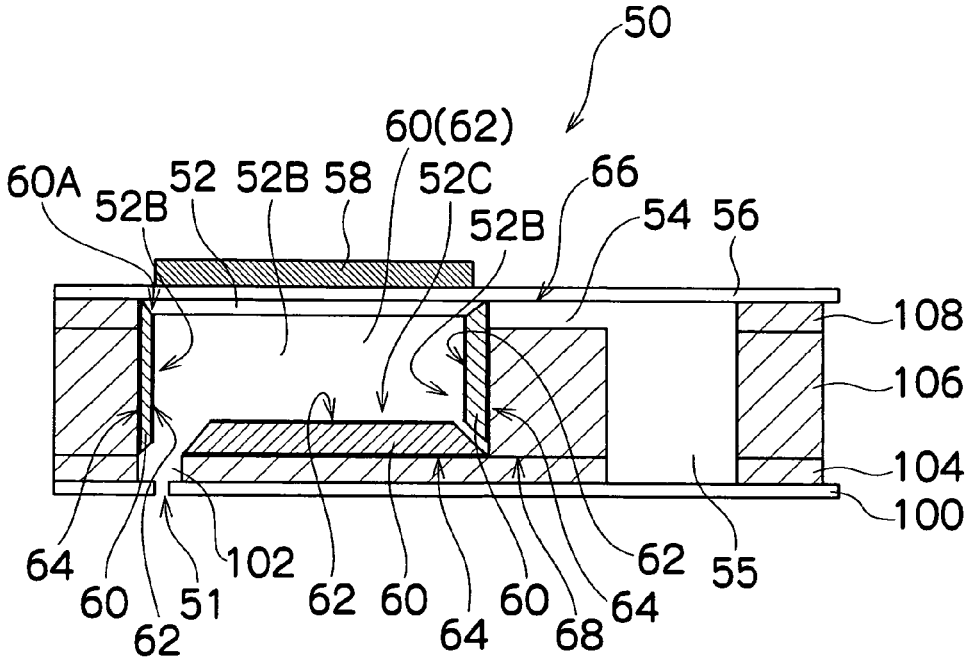
FIGS. 8A and 8B are cross-sectional diagrams showing one mode of the print head shown in FIG. 7.
Figure 8B:
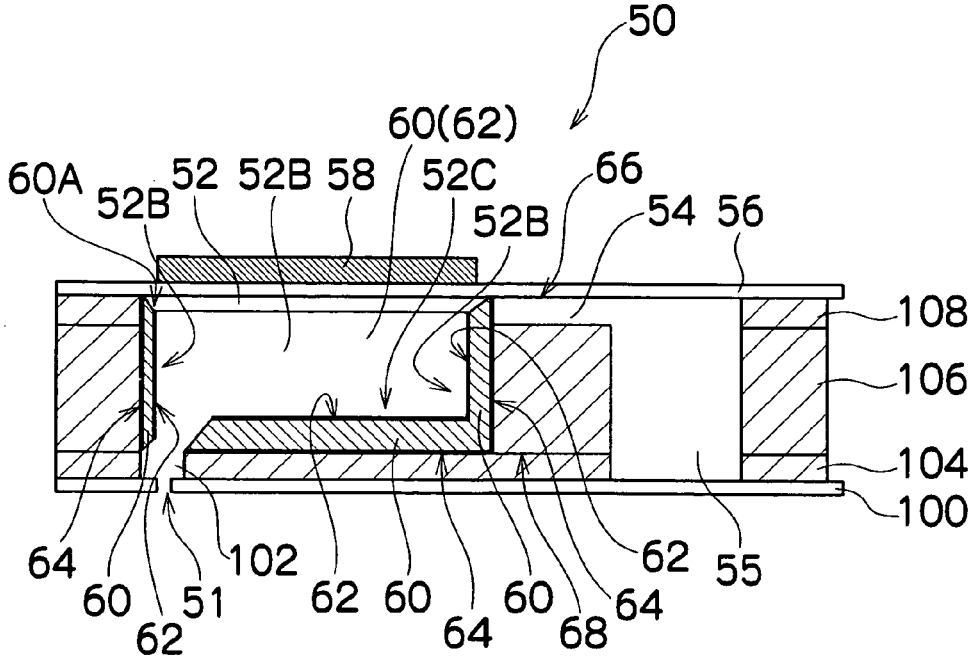

Next, a print head 50 according to a second embodiment of the present invention will be described. In FIGS. 8A and 8B, items which are the same as or similar to those in FIG. 7 are labeled with the same reference numerals and description thereof is omitted here.

In the second embodiment, determination piezoelectric elements 60 made from a ceramic material are formed on the respective determination piezoelectric element installation surfaces, by means of aerosol deposition (AD) process, sol-gel process, sputtering process, or the like. These determination piezoelectric elements 60 made from a ceramic material have a composition ratio which improves the pressure determination characteristics.

Firstly, pressure chambers 52 having a bathtub shape (recess shape) are formed by means of a similar method to that of the mode shown in FIG. 7.

If the determination piezoelectric elements 60 are to be formed by aerosol deposition process, for example, then an aerosol is blown onto the lower face from the ceiling side of the pressure chamber 52, by means of an aerosol nozzle (a nozzle which sprays an aerosol formed by micro-particles (powder) of the material which is to form the determination piezoelectric elements 60), thereby creating a determination piezoelectric element 60 on the bottom face 52C of the pressure chamber 52. On the other hand, since the four side faces 52B of the pressure chamber 52 (FIGS. 8A and 8B depict three of these four side faces) are substantially perpendicular to the direction in which the aerosol is sprayed onto the lower face 52C of the pressure chamber 52, then the relationship between the pressure chamber 52 and the aerosol nozzle is inclined relatively, and the determination piezoelectric elements 60 are formed successively on the side faces 52B, from an oblique direction.

In other words, the piezoelectric element forming apparatus which forms piezoelectric elements by means of aerosol deposition process, sol-gel process, sputtering process, or the like, and the side face 52B of the pressure chamber 52 (in other words, the determination piezoelectric element installation face) are inclined with respect to each other, and determination piezoelectric elements 60 having a tapered shape at the ends 60A are formed on the side faces 52B of the pressure chamber 52, as shown in FIG. 8A.

After forming the determination piezoelectric elements 60 in this manner, the determination common electrodes 62 are formed on the respective surfaces by means of sputtering process or the like, the determination common electrodes 62 of the respective determination piezoelectric elements 60 are bonded together and then bonded to the determination common electrode lead 66, whereupon a protective film is formed on the surfaces of the determination common electrodes 62 by means of coating, or the like, on the sections which make contact with the ink.

Determination individual electrodes 64 are formed on the respective surfaces before forming the determination piezoelectric elements 60. The determination individual electrodes 64 may be formed by means of aerosol deposition process, sol-gel process, sputtering process, or another technique.

The protective film formed on the surfaces of the determination common electrodes 62 and the determination individual electrodes 64 are of the same material and size as those of the first embodiment described above.

Techniques such as aerosol deposition process, sol-gel process, sputtering process, and the like, are suitable for forming piezoelectric elements on surfaces having a shape other than a flat shape, and aerosol deposition process in particular allows the compositional ratio of the piezoelectric element to be changed readily by altering the compositional ratio of the aerosol which is sprayed. It is also possible to form determination piezoelectric elements 60 having prescribed pressure determination characteristics by varying the compositional ratio of piezoelectric elements made from a ceramic type material.

In a mode where the determination piezoelectric elements 60 are formed by aerosol deposition process on the walls which form the pressure chamber 52, it is possible to form determination piezoelectric elements 60 on the walls independently as shown in FIG. 8A, or it is also possible to form determination piezoelectric elements 60 integrally on the side faces 52B and bottom face 52C of the pressure chamber 52 as shown in FIG. 8B. In the mode shown in FIG. 8B, it is possible to increase the surface area of the determination piezoelectric elements 60 and hence to improve the determination sensitivity.

In the mode shown in FIGS. 8A and 8B, similarly to the mode shown in FIG. 7, determination piezoelectric elements 60 having different thicknesses are provided on the various walls.

Third Embodiment

Next, a print head 50 according to a third embodiment of the present invention will be described. In the third embodiment, piezoelectric elements made of a ceramic type piezoelectric material are used for the determination piezoelectric elements 60B formed on the side faces 52B of the pressure chamber 52, whereas a piezoelectric element made of a resin type piezoelectric material is used for the determination piezoelectric element 60C formed on the bottom face 52C of the pressure chamber 52, the determination piezoelectric elements 60B and the determination piezoelectric element 60C being formed in separate steps.

Taking account of the linearity of the pressure wave inside the pressure chamber 52 (details of which are described hereinafter), it is possible to determine the pressure wave with good sensitivity if a piezoelectric element having excellent pressure determination characteristics is disposed on the face opposing the diaphragm 56.

Figure 9:
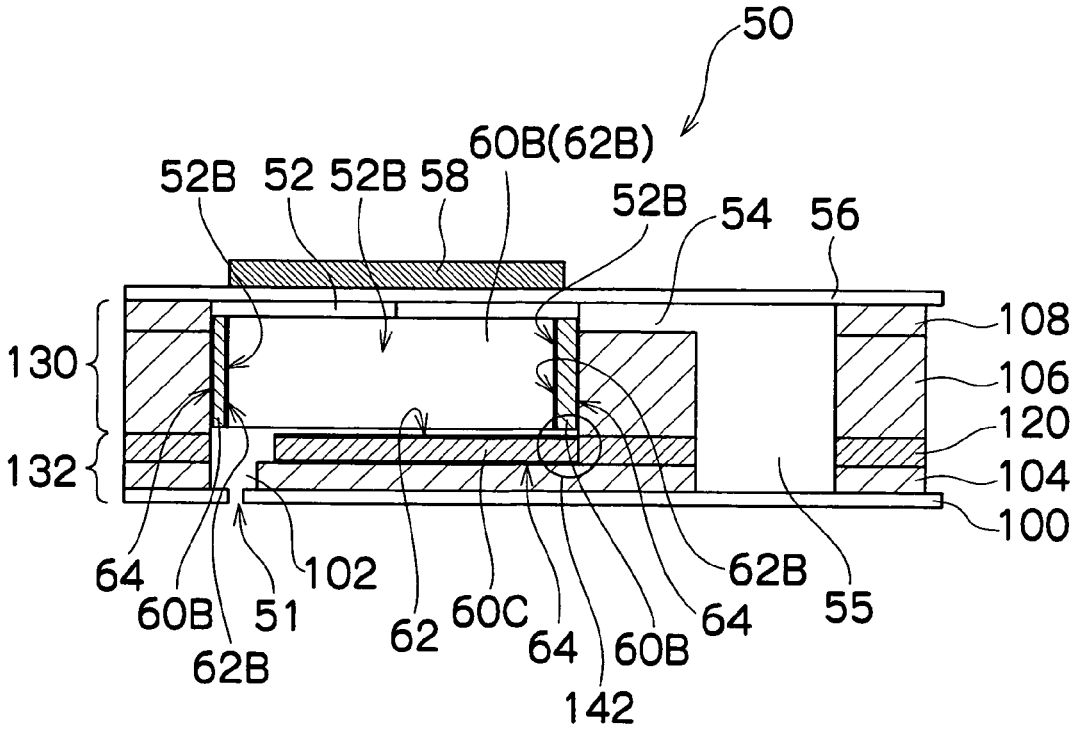
FIG. 9 is a cross-sectional diagram showing a further mode of the print head shown in FIG. 7.

In the mode shown in FIG. 9, firstly, a structural body 130 comprising the four side faces 52B of the pressure chamber 52 is formed by laminating thin stainless steel plates, silicon etching, resin molding, or the like, whereupon determination piezoelectric elements 60B are formed on the respective side faces 52B of the pressure chamber 52 (the inner faces of the structural body 130), using the technique stated in the first embodiment or the second embodiment described above. Determination common electrodes 62 and determination individual electrodes 64 are formed on the determination piezoelectric elements 60B by means of the technique stated in the first embodiment and the second embodiment described above.

On the other hand, an electrode layer for creating a determination individual electrode 64 is formed on the nozzle plate 100 which is made of a material such as stainless steel, silicon, polyimide, or the like, whereupon a determination piezoelectric element 60C made of a resin type piezoelectric material, such as PVDF, or P(VDF-TrFE), is formed by spin-coating or bonding a film-shaped piezoelectric element (in other words, a structural body 132 comprising a nozzle plate 100, a flow channel plate 104 and a determination piezoelectric element 60C is formed).

It is also possible to use a piezoelectric element formed from a ceramic type piezoelectric material, such as PZT, by aerosol deposition process, sol-gel process, or sputtering process, as the determination piezoelectric element 60C which is formed on the bottom face 52C of the pressure chamber 52.

A determination common electrode 62C is formed by sputtering process, or the like, on the determination piezoelectric element 60C formed in this way, whereupon it is bonded to the structural body 130 which has been formed separately. Thereupon, the determination common electrodes 62 and the determination individual electrodes 64 are respectively bonded together, and a protective film is formed by spin-coating, painting, or the like, onto the portions of the determination common electrodes 62 which make contact with the ink.

Figure 10A:
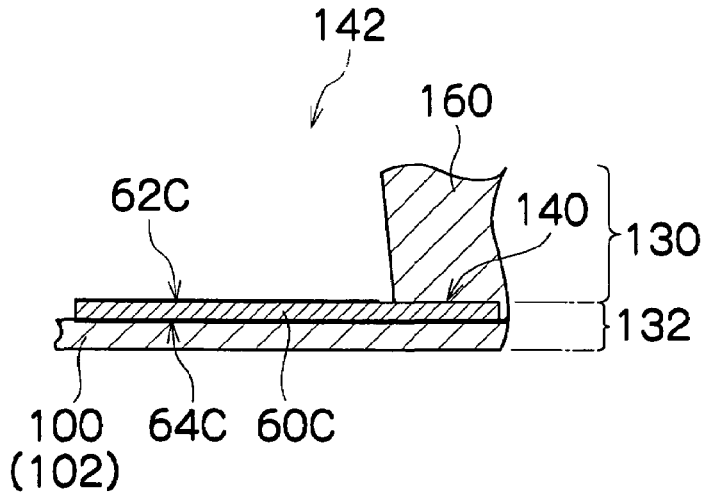
FIGS. 10A to 10C are enlarged views of the joint region shown in FIG. 7.

FIG. 10A is an enlarged view of the peripheral area of the joint region (marked by reference numeral 140 in FIG. 10A) between the structural body 130 comprising the members which form the side walls of the pressure chamber 52, and the structural body 132 comprising the nozzle plate 100, the flow channel plate 104 and the determination piezoelectric elements 60C. (This joint region is indicated by reference numeral 142 in FIG. 9.)

As shown in FIG. 10A, by forming the side wall members 160 which are to form the side walls of the pressure chambers 52 (the partitions between neighboring pressure chambers 52) in a tapered shape whereby the width is smaller at the bottom face side than at the ceiling side, it is possible to ensure that the determination piezoelectric element 60C provided on the bottom face of the pressure chamber 52 has a broad sensor surface (the surface which functions as a sensor; in other words, the surface on which the determination individual electrode 64C is provided). Furthermore, since a clearance can be guaranteed between the determination common electrode 62C and the side wall members 160, then insulation between the determination common electrode 62C and the side wall member 160 can be ensured.

Figure 10B:
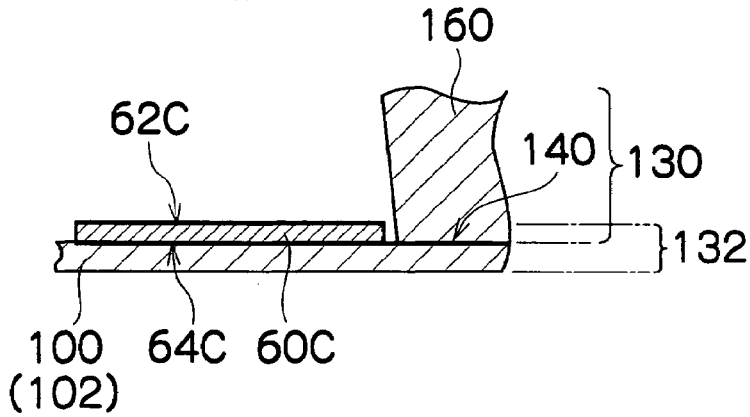
Figure 10C:
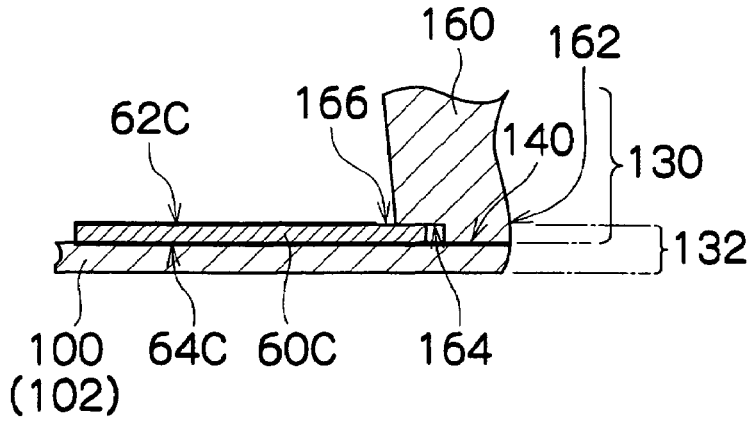

Moreover, FIGS. 10B and 10C show a mode where separate determination piezoelectric elements 60C for the pressure chambers 52 are provided on the lower faces of the respective pressure chambers 52.

In the mode shown in FIGS. 10B and 10C, there is a risk that positional displacement during bonding of the structural body 130 and the structural body 132 will give rise to damaging of the resin type piezoelectric elements made of PVDF, P(VDF-TrFE), or the like, used for the determination piezoelectric elements 60C provided on the bottom faces of the pressure chambers 52.

Therefore, if the side wall members 160 which are to form the side walls of the pressure chambers 52 are formed with a tapered shape, then it is possible to ensure clearance between the determination piezoelectric elements 60C and the side wall members 160, and therefore damage to the determination piezoelectric elements 60C provided on the bottom faces of the pressure chambers 52 can be prevented.

Moreover, it is also possible to absorb processing errors in the side wall members 160, and assembly errors between the structural body 130 and the structural body 132, by means of the clearances provided between the determination piezoelectric elements 60C and the side wall members 160. The gaps between the respective determination piezoelectric elements 60C and the side wall members 160 may be filled with the base material of the protective film, when a protective film is formed on the determination common electrodes 62.

Furthermore, as shown in FIG. 10C, a tapered projection 162 is provided on the bonding surface between each side wall member 160 and the structural body 132, and this projection 162 is bonded to the structural body 132. The projection-free region 164 where the projection 162 is not formed on the side wall member 160 is bonded to the determination common electrode-free region 166 where the determination piezoelectric element 60C and the determination common electrode 62C are not located. Rather than bonding the projection-free region 164 and the determination common electrode-free region 166, it is also possible to abut these regions together (place these regions in mutual contact), or it is also possible for these regions to be in a non-contact state.

In the mode shown in FIG. 10C, the determination piezoelectric elements 60C do not have to be divided for the pressure chambers 52, and holes corresponding to the shape of the projections 162 may be formed in an integrally formed determination piezoelectric element 60C, at positions corresponding to the projections 162.

The print head 50 having the composition described above comprises determination piezoelectric elements 60 for determining the pressure waves generated in the pressure chambers 52, provided on all of the inner surfaces of each pressure chamber 52 apart from the ceiling, and therefore a large surface area is used for determining the pressure wave and determination sensitivity is improved.

The determination piezoelectric elements 60 may be installed by bonding onto the inner faces of the pressure chamber 52, or they may be formed on the inner faces of the pressure chamber 52 by a method such as aerosol deposition process, sol-gel process, sputtering process, or the like.

In the present embodiment, the determination piezoelectric elements 60 are provided on all of the surfaces except for the ceiling, but of course, it is also possible to provide a determination piezoelectric element on the ceiling as well. Moreover, in the present embodiment, individual electrode determination piezoelectric elements 60 are provided on the respective surfaces and the electrodes (determination common electrodes 62 and determination individual electrodes 64) of these determination piezoelectric elements 60 are bonded respectively together, in such a manner that a determination signal is extracted via common electrode leads for the determination common electrodes 62 and the determination individual electrodes 64, (namely, from the determination common electrode lead 66 and the determination individual electrode lead 68). However, the determination piezoelectric elements 60 may also be formed in an integrated manner on the respective surfaces, or alternatively, separate electrode leads may be provided for the electrodes of the determination piezoelectric elements 60 (and in particular, the determination individual electrodes 64).

MODIFICATION EXAMPLE

Next, a modification example of the first to third embodiments described above will be explained.

Since the resonance frequency (frequency characteristics) of the determination piezoelectric element 60 can be varied by altering the thickness and rigidity of the determination piezoelectric element 60, then by providing determination piezoelectric elements 60 of different thicknesses and rigidities on the respective surfaces of the plurality of determination piezoelectric element installation surfaces of the pressure chamber 52, it is possible to vary the peak-sensitivity frequency between the respective surfaces, and hence the pressure wave can be determined with good sensitivity over a broad frequency range, for instance, in cases where the pressure in the pressure chamber 52 is determined while changing the drive frequency of the ejection piezoelectric element 58.

Figure 11A:
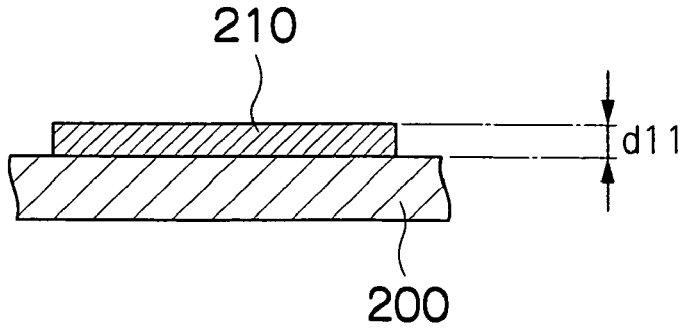
FIGS. 11A to 11C are cross-sectional diagrams showing a three-dimensional structure of a determination piezoelectric element provided in a print head according to an adaptation example of the present embodiment.
Figure 11B:
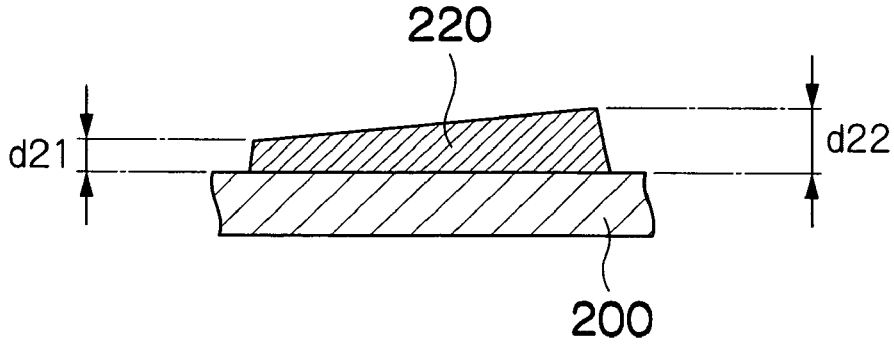
Figure 11C:
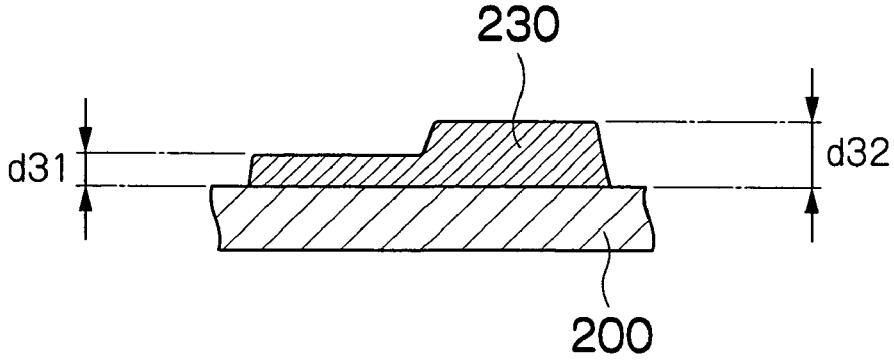

Furthermore, as shown in FIGS. 11B and 11C, if the thickness of the determination piezoelectric element 220 or 230 is varied on the same surface, then it is possible to determine a plurality of pressure waves having different frequencies, with good sensitivity, by means of one determination piezoelectric element.

FIG. 11A shows a mode where a piezoelectric element 210 having a uniform thickness of d11 is provided on a base member (for example, a wall member forming a side face of the pressure chamber 52), and FIG. 11B shows a piezoelectric element 220 having a thickness distribution (namely, a thickness which changes from d21 to d22). Furthermore, FIG. 11C shows a determination piezoelectric element 230 having a plurality of thicknesses (in this case, two thicknesses: d31 and d32).

The piezoelectric element 220 shown in FIG. 11B is suitable for use as a determination piezoelectric element when determining pressure waves generated in a case where the drive frequency changes continuously. The piezoelectric element 230 shown in FIG. 11C is suitable for use as a determination piezoelectric element when determining a pressure wave having a particular frequency band.

As shown in FIG. 11B and FIG. 11C, portions of different thicknesses may be provided on the same surface, but this increases the difficulty of the manufacturing process. Furthermore, since the polarization voltage applied during the polarization of the determination piezoelectric elements is directly proportional to the thickness of the piezoelectric element, the polarization voltage is decided in accordance with the thickness portion of the piezoelectric element, if it has different thicknesses in different parts.

In the portions of lower thickness, a voltage higher than the polarization voltage that would be suitable for that thickness is applied, and hence there is a risk of dielectric breakdown. In order to resolve this problem, the individual electrode should be divided into regions of different thicknesses and polarization voltages suited to the respective thicknesses should be applied.

Moreover, if the surface which makes contact with the ink has the shape shown in FIG. 11C, then air bubbles in the ink are liable to become trapped in the undulating shape, and hence performance in expelling air bubbles declines.

Therefore, desirably, the thickness of the determination piezoelectric elements 60 is varied between the respective installation surfaces, and even more desirably, determination individual electrodes 64 are provided respectively on the installation surfaces The resonance frequency of a pressure wave generated in a pressure chamber 52 when an air bubble occurs inside the pressure chamber 52 is generally lower than the prescribed resonance frequency, and the ratio of decline in the resonance frequency of the pressure chamber 52 is dependent on the size of the air bubble. More specifically, if the air bubble is large in size, then the ratio of decline in the resonance frequency of the pressure chamber 52 will become larger.

Moreover, the size range of the air bubbles occurring in the pressure chamber 52 which are to be determined can be estimated. To give one example of the size range of the air bubbles, in a general inkjet recording apparatus, the lower limit is approximately 5 μm to 10 μm and the upper limit is approximately 20 μm to 50 μm.

The lower limit is estimated from the size at which an air bubble will have an effect on ejection, and the upper limit is estimated from the largest possible size of an air bubble which could enter into the pressure chamber 52, given the structure of the filter provided in the supply side flow channel from the ink tank to the pressure chamber 52, and the size of the nozzle 51.

It is also possible to alter the resonance characteristics, and properties such as the dynamic range, by varying the rigidity of the determination piezoelectric elements 60, as well as the thickness.

More specifically, it is possible to determine the resonance frequency of the pressure chamber 52 in accordance with the size of an air bubble, and if the size of the air bubble changes, the resonance frequency of the pressure chamber 52 also changes. Therefore, determination sensitivity can be improved by providing a plurality of determination piezoelectric elements 60 having resonance frequencies which correspond to the estimated size range of the air bubbles.

The determinable range of the air bubble size described above is merely an example, and the range of the air bubble size can be specified in accordance with the design of the print head 50.

In a print head using general piezoelectric elements (piezoelectric actuators), ink ejection and refilling are performed by utilizing the resonance effects of the pressure chambers. This resonance frequency is in a range between several tens kHz to several hundreds kHz, as shown in by curves 300 to 308 in FIG. 12, and in the print head 50 in the present embodiment, piezoelectric elements which deform in the g31 direction (g31 mode piezoelectric elements) are used for the determination piezoelectric elements 60, and the pressure in the pressure chambers 52 is determined on the basis of the distortion of the sensor surfaces (the surfaces which make contact with the ink inside the pressure chamber 52 and receive pressure from the ink). More specifically, the resonance frequencies of the determination piezoelectric elements 60 are set to a frequency range estimated in accordance with the size of the air bubbles.

Figure 12:
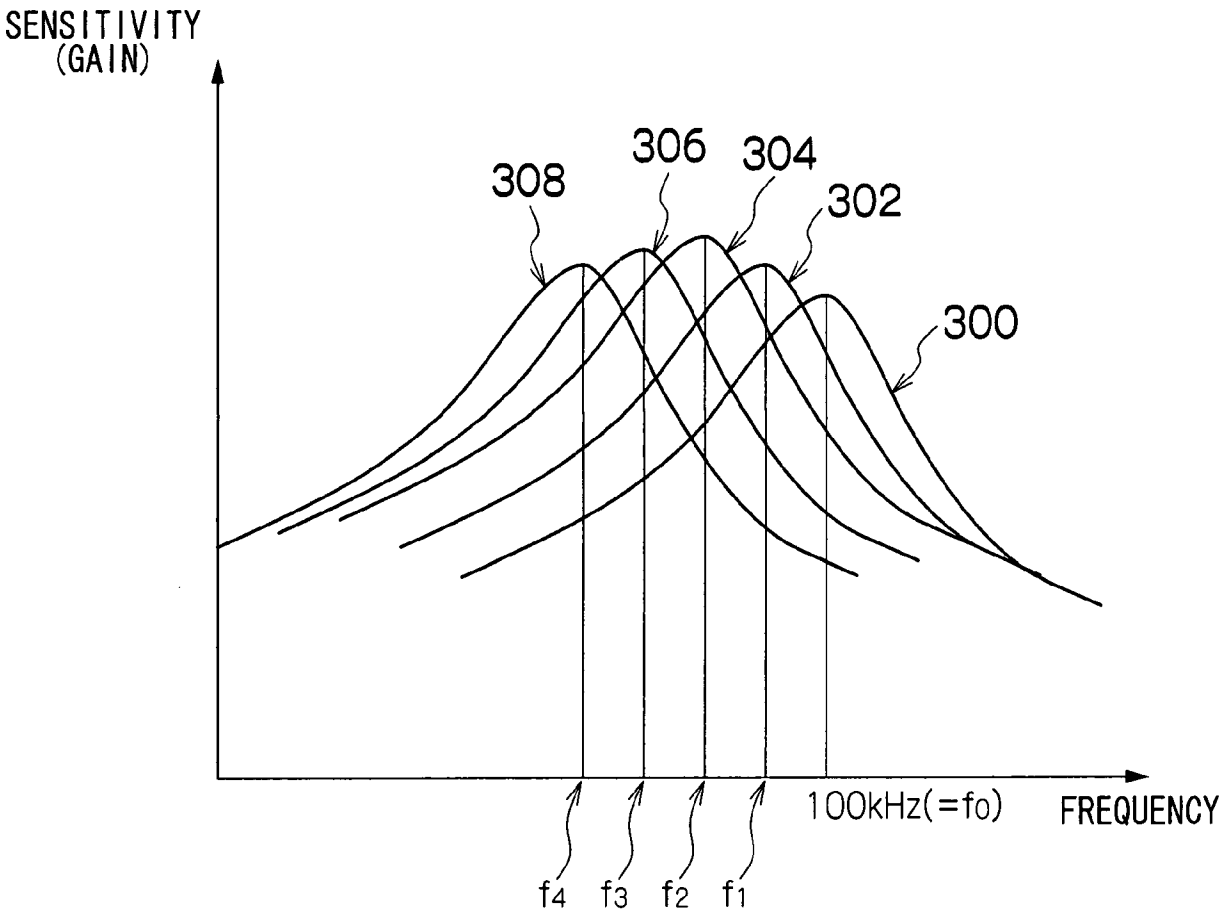
FIG. 12 is a diagram showing the resonance frequency of a determination piezoelectric element provided in a general print head.

FIG. 12 shows the relationship between the sensitivity (gain) of a determination piezoelectric element 60 and the frequency of the determined pressure wave. As shown in FIG. 12, five piezoelectric elements having different frequency characteristics (resonance frequencies) as indicated by the curves 300 to 308 are provided on the different inner surfaces of the pressure chamber 52.

The resonance frequencies f0-f4 used in the determination piezoelectric elements 60 are determined from the estimated size of the air bubbles. In the present embodiment, the resonance frequency f0 indicates a resonance frequency 100 kHz of the pressure chamber 52 when no air bubble has occurred (in other words, in a normal ejection state), and the resonance frequencies f1 to f4 indicate resonance frequencies in the case of abnormal pressure states in the pressure chamber 52.

In an inkjet recording apparatus having a mist ejection-type print head which uses an ultrasonic wave of several MHz as a drive frequency for the piezoelectric elements for ejecting ink (in the present embodiment, the ejection piezoelectric elements 58), and ejects ink droplets of very small volume in the form of a mist by causing the meniscus in the nozzle to vibrate ultrasonically, the size of the ejected mist is changed by altering the drive frequency of the piezoelectric elements. In other words, in order to produce a large change in the size of the mist, it is necessary to make a large change in the drive frequency of the piezoelectric elements, within the ultrasonic frequency range.

For example, if the ink droplets are formed as a mist by using a capillary wave, then the diameter of the mist is almost directly proportional to the wavelength $\lambda c$ of the capillary wave, which is expressed as $$\lambda c \propto \left(\frac{\pi \times \sigma}{\rho \times f^2}\right)^{\frac{1}{3}},$$

where ρ is the ink density, σ is the surface tension of the ink, and f is the drive frequency.

If an ultrasonic pressure wave is determined by using a film-like pressure sensor (for example, a piezoelectric element), then a technique is used to increase the determination sensitivity by setting the film thickness of the pressure sensor to ½ of the wavelength of the pressure wave and thus generating a resonance effect between the pressure sensor and the pressure wave.

Therefore, in a mist ejection type print head such as that described above, it is effective to provide a plurality of pressure determination films (piezoelectric elements) which resonate with the drive frequency in accordance with the mist size, as the determination piezoelectric elements 60 shown in FIG. 4 and the other drawings. In the print head according to the present invention, determination piezoelectric elements 60 having a thickness or rigidity corresponding to different frequencies in the ultrasonic range are provided on the respective surfaces which constitute the inner surfaces of the pressure chamber 52, and pressure waves can be determined with good sensitivity over a broader range of frequencies.

Figure 13:
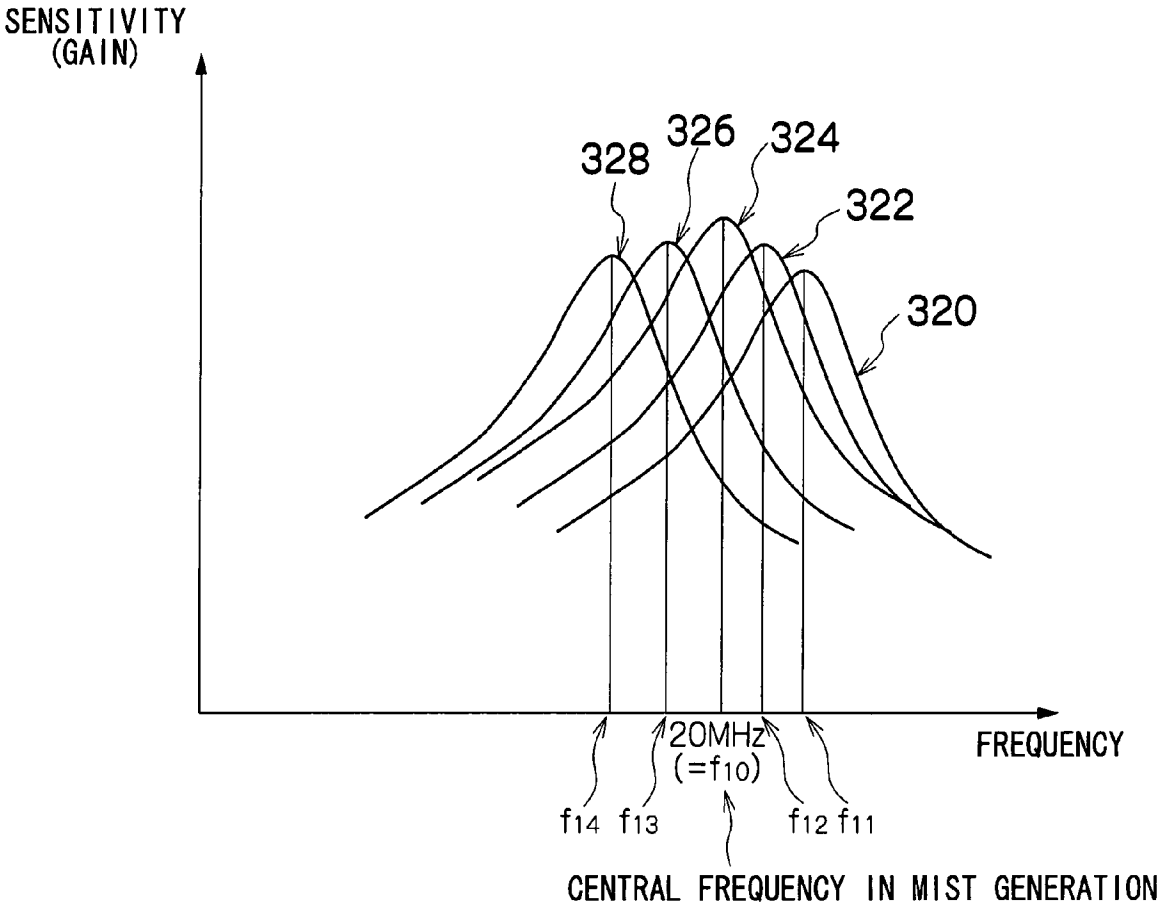
FIG. 13 is a diagram showing the resonance frequency of a determination piezoelectric element provided in a mist ejection type print head.

FIG. 13 shows the resonance frequencies of determination piezoelectric elements 60 and the corresponding sensitivity (gain) of the determination piezoelectric elements 60, in a mist ejection type print head.

As shown in FIG. 13, five determination piezoelectric elements 60 having the resonance frequencies f10 to f14 (namely, the frequency characteristics in curves 320 to 328) are provided on the five inner surfaces of the pressure chamber 52 apart from the ceiling. The resonance frequency 20 MHz indicated by f10 is the frequency of the pressure wave in a normal ejection state, and the resonance frequencies in f11 to f14 are the frequencies of pressure waves when the pressure chamber 52 is in an abnormal pressure state.

The speed of sound in the PVDF is 2260 m/s, the speed of sound in P(VDF-TrFE) is 2400 m/s, and the speed of sound in PZT is 4600 m/s. A piezoelectric element made of PVDF and having a resonance frequency of 20 MHz will have a thickness (film thickness) of approximately 56.5 μm.

When determining a pressure wave having a frequency in the ultrasonic range, if an air bubble is present in the pressure chamber 52, not only will the resonance frequency change, but furthermore, the pressure wave propagated inside the ink will be blocked by the air bubble and hence there will be a fall in the voltage of the determination signal obtained from the determination piezoelectric elements. Therefore, it is possible to judge the presence or absence of an air bubble inside the pressure chamber 52 by monitoring the voltage of the determination signal, as well as change in the resonance frequency.

According to the present embodiment, if the determination piezoelectric elements 60 provided on the respective surfaces are composed so as to have mutually different resonance frequencies, then the pressure can be determined with good sensitivity at various different frequencies, even if the pressure wave has a plurality of frequencies (in other words, a broad frequency range). One example of a mode for varying the resonance frequency of the determination piezoelectric elements 60 is a mode in which the thickness and rigidity of the respective determination piezoelectric elements 60 are varied.

The present embodiment describes a mode in which five determination piezoelectric elements 60 provided on the inner faces of the pressure chamber 52 have respectively different resonance frequencies, but it is also possible to adopt a composition in which at least two of the five determination piezoelectric elements 60 have different resonance frequencies.

Furthermore, the resonance frequency of the determination piezoelectric elements 60 is decided in accordance with the drive frequency of the ejection piezoelectric elements 58. In a general inkjet recording apparatus, the drive frequency of the ejection piezoelectric elements is in the range of several tens kHz to several hundreds kHz, and in a mist ejection type inkjet recording apparatus, the drive frequency of the ejection piezoelectric elements is in the range of several MHz to several tens MHz.

ADAPTATION EXAMPLE

Next, an adaptation of the present embodiment will be described.

As described above, the print head 50 comprises determination piezoelectric elements 60 for determining the pressure inside the pressure chambers 52 (the pressure of the ink inside the pressure chambers 52), provided respectively on five inner faces of each pressure chamber 52, namely, the four side faces and the bottom face thereof; and these determination piezoelectric elements 60 have respectively different resonance frequencies (for example, f0-f4 shown in FIG. 12 or f10-f14 shown in FIG. 13).

The pressure wave generated in the pressure chamber 52 has high linearity, and firstly, it applies a high pressure to the surface opposing the diaphragm 56, whereupon the pressure wave is reflected and dispersed by the surface opposing the diaphragm and propagates to the other surfaces. This disturbance of the front of the pressure wave results in broad frequency characteristics having a broad frequency range.

Of the five determination piezoelectric elements 60 having different resonance frequencies, if a determination piezoelectric element 60 having a resonance frequency which corresponds to (is substantially the same as) the most commonly used drive frequency of the ejection piezoelectric element 58 is disposed on the surface opposing the diaphragm (in the present embodiment, the bottom face 52C of the pressure chamber 52), then it is possible to determine a pressure wave having a frequency which occurs habitually, with good sensitivity.

Furthermore, if there is a difference between the surface areas on which the determination piezoelectric elements 60 can be provided on the respective faces, then it is possible to provide a determination piezoelectric element 60 having a resonance frequency corresponding to the most commonly used drive frequency of the ejection piezoelectric element 58, on the face having the largest possible surface area for providing the determination piezoelectric element 60. By increasing the surface area of the determination piezoelectric element 60 (the determination common electrode 62), the current (charge) of the determination signal is increased, and hence determination sensitivity can be raised.

Moreover, a determination piezoelectric element 60 having a higher resonance frequency should be provided on the surface opposing the diaphragm, and determination piezoelectric elements 60 having lower resonance frequencies should be provided on the surfaces which are substantially perpendicular to the diaphragm 56 (in the present embodiment, the four side faces of the pressure chamber 52).

According to this adaptation example, the positioning of the determination piezoelectric elements 60 should be decided in accordance with the propagation characteristics of the pressure wave generated in the pressure chamber.

In the above-described embodiments, an inkjet recording apparatus which forms images on recording paper 16 by ejecting ink from nozzles 51 has been described, but the scope of application of the present invention is not limited to this and it may also be applied to a liquid ejection apparatus which ejects a liquid such as water, liquid chemical, treatment liquid, or the like, from ejection ports.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

an ejection port which ejects liquid onto an ejection receiving medium;

a pressure chamber which applies pressure for ejection to the liquid to be ejected from the ejection port; and a plurality of pressure determination elements which are provided on a plurality of wall faces constituting the pressure chamber and have characteristics different from each other.

2. The liquid ejection head as defined in claim 1, wherein the plurality of pressure determination elements are disposed in such a manner that one pressure determination element is provided on one wall face.

3. The liquid ejection head as defined in claim 1, wherein the different characteristics include resonance frequencies.

4. The liquid ejection head as defined in claim 3, further comprising:

an actuator which deforms the pressure chamber and is provided on at least one of the wall faces constituting the pressure chamber, wherein the pressure determination element having the resonance frequency corresponding to a drive frequency of the actuator is provided on the wall face having a greatest surface area for disposing the pressure determination element.

5. The liquid ejection head as defined in claim 3, further comprising:

an actuator which deforms the pressure chamber and is provided on at least one of the wall faces constituting the pressure chamber, wherein the pressure determination element having the resonance frequency corresponding to a drive frequency of the actuator is provided on the wall face opposing the wall face on which the actuator is provided.

6. The liquid ejection head as defined in claim 3, further comprising:

an actuator which deforms the pressure chamber and is provided on at least one of the wall faces constituting the pressure chamber, wherein the pressure determination element having the highest resonance frequency is provided on the wall face opposing the wall face on which the actuator is provided.

7. The liquid ejection head as defined in claim 3, wherein:

the pressure determination elements include piezoelectric elements; and the resonance frequencies of the piezoelectric elements are differentiated by differentiating at least one of thickness and rigidity of the piezoelectric elements.

8. The liquid ejection head of claim 1, wherein each pressure determination element is a pressure sensing element.

9. The liquid ejection head of claim 1, further comprising:

a determination electrode, disposed on the plurality of pressure determination elements, that extracts a determination signal from said plurality of pressure determination elements; and a signal processing unit, connected to the determination electrode, that processes the extracted determination signal according to a prescribed signal processing.

10. The liquid ejection head of claim 1, wherein each pressure determination element is comprised of a resin type material.

11. A liquid ejection head, comprising:

an ejection port which ejects liquid onto an ejection receiving medium;

a pressure chamber which applies pressure for ejection to the liquid to be ejected from the ejection port; and a pressure determination element which is disposed so as to cover at least two of the wall faces constituting the pressure chamber and has the different characteristics respectively on the at least two of the wall faces.

12. The liquid ejection head as defined in claim 11, wherein the different characteristics include resonance frequencies.

13. The liquid ejection head as defined in claim 12, further comprising:

an actuator which deforms the pressure chamber and is provided on at least one of the wall faces constituting the pressure chamber, wherein the part of the pressure determination element having the resonance frequency corresponding to a drive frequency of the actuator is provided on the wall face having a greatest surface area for disposing the pressure determination element.

14. The liquid ejection head as defined in claim 12, further comprising:

an actuator which deforms the pressure chamber and is provided on at least one of the wall faces constituting the pressure chamber, wherein the part of the pressure determination element having the resonance frequency corresponding to a drive frequency of the actuator is provided on the wall face opposing the wall face on which the actuator is provided.

15. The liquid ejection head as defined in claim 12, further comprising:

an actuator which deforms the pressure chamber and is provided on at least one of the wall faces constituting the pressure chamber, wherein the part of the pressure determination element having the highest resonance frequency is provided on the wall face opposing the wall face on which the actuator is provided.

16. The liquid ejection head as defined in claim 12, wherein:

the pressure determination element includes a piezoelectric element; and the resonance frequencies of the parts of the piezoelectric elements are differentiated by differentiating at least one of thickness and rigidity of the parts of the piezoelectric element.

17. The liquid ejection head of claim 11, wherein the pressure determination element is a pressure sensing element.

18. The liquid ejection head of claim 11, further comprising:

a determination electrode, disposed on the pressure determination element, that extracts a determination signal from the pressure determination element; and a signal processing unit, connected to the determination electrode, that processes the extracted determination signal according to a prescribed signal processing.

19. The liquid ejection head of claim 11, wherein the pressure determination element is comprised of a resin type material.

20. The liquid ejection head of claim 11, wherein the pressure determination element has the characteristics changing sequentially.

21. The liquid ejection head of claim 11, wherein the pressure determination element has at least two portions having the different characteristics.

* * * * *